United States Patent [19]

Nazem et al.

[11] 4,301,135

[45] Nov. 17, 1981

[54] PROCESS FOR SPINNING PITCH FIBER INTO A HOT GASEOUS ENVIRONMENT

[75] Inventors: Faramarz Nazem, Strongsville; Robert C. Stroup, Bay Village, both of Ohio

[73] Assignee: Union Carbide Corporation, New York, N.Y.

[21] Appl. No.: 106,740

[22] Filed: Dec. 26, 1979

[51] Int. Cl.[3] ..... D01F 9/12

[52] U.S. Cl. ..... 423/447.4; 264/29.2; 264/176 F; 423/447.6

[58] Field of Search ..... 423/447.2–447.8; 264/29.2, 176 F

[56] References Cited

U.S. PATENT DOCUMENTS

| | | | |
|---|---|---|---|
| 2,376,511 | 5/1945 | Saunders et al. | 525/58 |
| 3,552,922 | 1/1971 | Ishikawa et al. | 423/447.4 |
| 3,595,946 | 7/1971 | Joo et al. | 423/447.8 |
| 3,702,054 | 11/1972 | Araki et al. | 264/29.2 |
| 3,919,387 | 11/1975 | Singer | 264/344 |
| 3,976,729 | 8/1976 | Lewis et al. | 264/29.7 |
| 3,995,014 | 11/1976 | Lewis | 423/447.4 |
| 4,005,183 | 1/1977 | Singer | 423/447.2 |
| 4,032,430 | 6/1977 | Lewis | 208/39 |

FOREIGN PATENT DOCUMENTS

| | | | |
|---|---|---|---|
| 51-12740 | 4/1976 | Japan | 264/29.2 |
| 2005298 | 4/1979 | United Kingdom . | |

*Primary Examiner*—Jay H. Woo
*Attorney, Agent, or Firm*—David Fink

[57] ABSTRACT

In the process of producing a carbon fiber from mesophase pitch, including the steps of spinning the pitch fiber from a spinnerette, thermosetting the pitch fiber, and thereafter, carbonizing the pitch fiber to produce the carbon fiber, wherein the improvement comprises spinning the pitch fiber into a hot gaseous environment.

5 Claims, 1 Drawing Figure

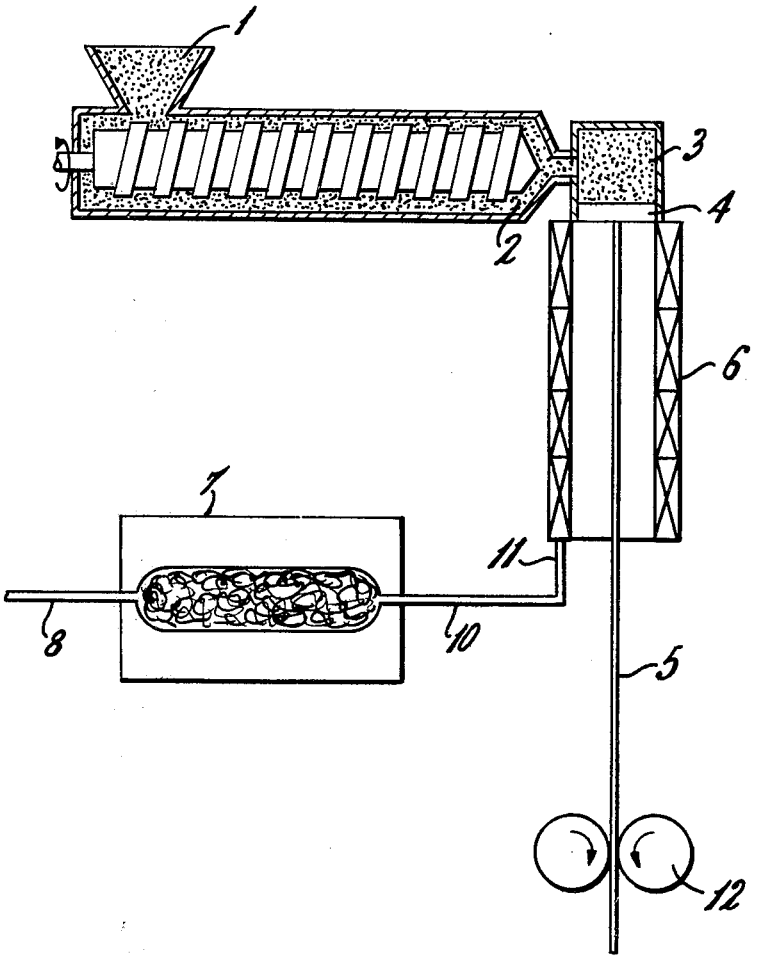
1
2
3
4
5
6
7
8
9
10
11
12

PROCESS FOR SPINNING PITCH FIBER INTO A HOT GASEOUS ENVIRONMENT

The invention relates to a process for producing a carbon fiber and particularly to the process of producing a carbon fiber from a mesophase pitch.

The conventional method for producing a carbon fiber from a mesophase pitch includes the steps of spinning the pitch into a continuous filament or pitch fiber while quenching the pitch fiber with a cold nitrogen gas to minimize the residue build-up on the edge of the capillary exits of the spinnerette and to improve spinnability. Thereafter, the pitch fiber is transported to a hot air oven to thermoset the pitch fiber, and subsequently, the pitch fiber is carbonized to obtain the carbon fiber.

It is believed that the use of quenching nitrogen arose because the exclusion of oxygen at the spinnerette face was thought to be necessary to eliminate pitch build-up and consequent fiber breakage. In addition, some spinning theories in the literature indicated that the quenching nitrogen would increase the viscosity of the pitch fiber and thereby improve the spinning operation by minimizing fiber breakage during the draw down.

Of the various types of pitches employed, mesophase pitch has been known to be suitable for producing carbon fibers having excellent properties which lend themselves to commercial exploitation. It is known that mesophase derived carbon fibers are light weight, strong, stiff, electrically conductive, and both chemically and thermally inert. The mesophase derived carbon fibers perform well as reinforcement in composites and have found use in aerospace applications and quality sporting equipment.

In addition, carbon fibers produced from mesophase pitch exhibit high preferred molecular orientation and relatively excellent mechanical properties:

As used herein, the term "pitch" is to be understood as it is used in the instant art and generally refers to a carbonaceous residue consisting of a complex mixture of primarily aromatic organic compounds which is solid at room temperature and exhibits a relatively broad melting or softening temperature range.

As used herein; the term "mesophase" is to be understood as it is used in the instant art and generally is synonymous with liquid crystal. That is, a state of matter which is intermediate between crystalline solid and a amorphous liquid. Ordinarily, the material in the mesophase state exhibits both anisotrophic and liquid properties.

As used herein, the term "mesophase - containing pitch" is a pitch containing less than about 40% by weight mesophase and the non-mesophase portion or isotropic phase is the continuous phase.

As used herein, the term "mesophase pitch" is a pitch containing more than about 40% by weight mesophase and is capable of forming a continuous anisotropic phase when dispersed by agitation or the like in accordance with the prior art.

As used herein, the term "draw ratio" is the ratio of the area of the cross section of the capillary exit of the spinnerette divided by the area of the cross section of the draw pitch fiber.

The following patents are representative of the prior art and are incorporated herein by reference:

U.S. Pat. No. 4,005,183 to Singer,
U.S. Pat. No. 3,919,387 to Singer,
U.S. Pat. No. 4,032,430 and U.S. Pat. No. 3,976,729 to Lewis et al,
U.S. Pat. No. 3,995,014 to Lewis, and
British Patent 2,005,298 to Chwastiak.

One of the principal objects of the invention is the process of producing a carbon fiber from mesophase pitch, including the steps of spinning a pitch fiber from a spinnerette, thermosetting the pitch fiber, and thereafter, carbonizing the pitch fiber to produce carbon fiber, wherein the improvement comprises spinning the pitch fiber into a hot gaseous environment.

Another object of the invention is the use of a gaseous environment in the temperature range of from about 150° C. to about 400° C. with a volumetric flow rate of from about 0.1 to about 30 cubic feet per hour.

A further object of the invention is the use of nitrogen or other inert gases for the gaseous environment. The use of the hot inert gas improves the preferred orientation of the pitch fiber at high draw ratios, greater than about 40 units of draw rates.

Yet another object of the invention is the use of hot oxygen for the gaseous environment because it not only improves the preferred orientation for all draw ratios but also thermosets the pitch fiber prior to the pitch fiber contacting any physical equipment. This results in an easier handling of the pitch fiber and eliminates the necessity for coating the pitch fibers in a process called "sizing" to prevent pitch fibers from adhering to each other. The elimination of the sizing not only provides a savings in the cost of operation, but also precludes the occurrence of surface defects on the fibers in the subsequent processing operation arising from the presence of sizing.

Instead of oxygen, other hot oxidizing gases such as air and ozone can be used. An appropriate oxidizing gas can be determined by simple experimentations.

Preferably, the mesophase pitch contains at least about 70% by weight mesophase.

In accordance with conventional processes, the spinning operation can take place with the pitch fiber being drawn down. The instant invention with hot oxygen permits the draw down range to exceed the conventional draw ratio while providing a good quality carbon fiber. It is well known from the prior art that drawing down enhances the preferred orientation within the fiber and also allows the production of small-diameter fibers.

Preferably, carbon fibers according to the instant invention have diameters in the range of from about 5 to about 147 microns.

The amount of thermosetting depends in part upon the temperature of the oxidizing gas being supplied, the duration of time the pitch fiber is permitted to thermoset and the degree of oxidizing nature of the gas. A thermoset layer of up to approximately 2 microns can be obtained but even a low degree of thermosetting of a pitch fiber is sufficient to improve mechanical properties such as tensile modulus and tensile strength and to improve the handling characteristics of the fiber.

Preferably, the oxidizing gas establishing the gaseous environment has a temperature of at least about 150° C. and no more than about 400° C. The lowest suitable temperature depends upon the melting point of the pitch being used, the higher the melting point the higher the minimum temperature needed. The maximum temperature is based on tests which show that above certain temperatures there is a tendency for the pitch fiber to become weakened and result in breakage.

Preferably, oxygen or air is used in this temperature range and more preferably oxygen is used.

For a fuller understanding of the nature and objects of the invention, reference should be had to the following detailed description, taken in connection with the FIGURE which shows a diagrammic cross section of an apparatus for carrying out the invention.

In carrying the invention into effect, several embodiments have been selected for description in the specification and reference is had to the embodiment shown in the FIGURE.

The FIGURE shows a simplified apparatus for practicing the invention. Basically, the apparatus is a monofilament spinning system which has been modified to include a hot gas delivery system rather than quenching nitrogen.

An extruder 1 forces liquid mesophase pitch 2 into a reservoir 3. The mesophase pitch 2 has a Mettler softening point of about 325° C. and contains about 77% by weight mesophase. The reservoir 3 is maintained at a temperature of about 339° C. in accordance with conventional practice.

The mesophase pitch 2 moves from the reservoir 3 through a capillary die 4 which is also maintained at a temperature of about 339° C.

The capillary opening in the capillary die 4 extrudes an extrudate which becomes pitch fiber 5. The diameter of the capillary opening is about 0.020 inch.

The pitch fiber 5 is thermoset in a thermosetting furnace 6 which could be maintained within ±1° C. for any selected temperature in the range of from about 150° C. to about 400° C.

The oxidizing gas is oxygen. A preheater 7 is used to raise the temperature of the oxygen to about 358° C. Although the oxidizing gas need not be preheated, it has been found that the preheated oxidizing gas such as oxygen and air produces a higher degree of thermosetting in a shorter period of time.

Oxygen is supplied to the preheater 7 at inlet 8. The heated oxygen exists at outlet 10 which is connected to the thermosetting furnace 6 by conduit 12. The thermosetting furnace 6 includes an internal distribution system for distributing the heated oxygen around the pitch fibers 5. The oxygen supply rate to the pitch fibers 5 can vary from about 3 to about 15 cubic feet per hour.

The pitch fiber is thermoset while also subjected to tension from draw down arising from a draw-down device 12. The speed of the draw-down device 12 was varied to produce pitch fibers 5 having diameters in the range of from about 58 to about 147 microns. A separate test was carried out to produce a pitch fiber having a diameter of about 5 microns.

The thermosetting furnace 6 is about 10 inches long and typical residence times for the termosetting set up are as follows.

For a pitch fiber diameter of about 57 microns, the take-up speed of the draw-down device 12 was about 263 centimeters per second and the residence time of the thermosetting was about 0.01 second. It should be realized that the average speed of the portion of the pitch fiber in the thermosetting furnace 6 is much lower than the take-up speed.

The drawn down pitch fibers are subsequently carbonized in an inert atmosphere at about 1700° C. in accordance with conventional practice.

Tests were carried out to compare the amount of preferred orientation between pitch fibers produced according to the invention and pitch fibers prepared according to the conventional methods.

The amount of preferred orientation of the pitch fibers is determined by subjecting the pitch fiber to x-rays to establish an x-ray diffraction pattern. A high degree of preferred orientation of pitch molecules parallel to the fiber axis is apparent from the presence of short arcs which constitute the (002) band of the diffraction pattern. Microdensitometer scanning of the (002) band of the x-ray film indicates the preferred orientation angle which ranges from the theoretical limit of about 23 degrees to the typical commercial upper limit of about 65 degrees as expressed by the full width at half maximum of the azimuthal intensity distribution (FWHM). The lower the angle, the better the preferred orientation.

Additional tests were carried out using instead of hot oxygen the following gases: hot nitrogen at 317° C., air at ambient temperature, and quenching nitrogen in accordance with conventional practice.

Table 1 shows a comparison between pitch fibers made according to the forgoing tests.

TABLE 1

| Draw Ratio | Quenching Nitrogen FWHM, degree | Hot Oxygen FWHM, degree | Hot Nitrogen FWHM, degree | Ambient Air FWHM, degree |
|---|---|---|---|---|
| 12 | 32 | 27 | 30 | 25 |
| 24 | 32.5 | — | 30 | 28 |
| 36 | 36 | 26 | 29.5 | 31 |
| 48 | 40.2 | 26 | 30 | 31 |
| 60 | — | 27 | 33.5 | — |

It can be seen from Table 1 that increasing the draw ratio reduces the preferred orientation for both quenching nitrogen and ambient air as indicated by the increased FWHM. Quenching nitrogen is used as part of the conventional practice. The pitch fibers made according to the invention show superior preferred orientation for high draw ratios.

Additional pitch fibers were produced using capillaries of 0.013 inch and 0.004 inch in diameter. It was found that no clogging of the capillaries resulted from the presence of the hot oxygen and good quality pitch fibers were obtained. The draw down ratio for 0.013 inch diameter capillary was 1470 without any unusual problems associated with spinning operations. The extrudate from the 0.004 inch diameter capillary was subjected to a draw ratio of about 100.

We wish it to be understood that we do not desire to be limited to the exact details shown and described herein, or other modifications that occur to a person skilled in the arts.

Having thus described the invention, what we claim as new and desired to be secured by Letters Patent, is as follows:

What is claimed is:

1. In a process of producing a carbon fiber from mesophase pitch having at least about 70% by weight mesophase, including the steps of spinning a pitch fiber from the mesophase pitch using a spinnerette, thermosetting the pitch fiber, and thereafter, carbonizing the pitch fiber to produce the carbon fiber, wherein the improvement comprises spinning the pitch fiber into an inert gaseous environment having a temperature of from about 150° C. to about 400° C.

2. The process of claim 1, wherein said gaseous environment is nitrogen.

3. The process of claim 1, wherein the spinning has a draw-down ratio in the range of about 12:1 to about 1470:1.

4. The process of claim 1, wherein gas for the said gaseous environment is supplied at the rate from about 0.1 to about 30 cubic feet per hour.

5. The process of claim 4, further comprising preheating said gas before said gas is introduced into said gaseous environment.

* * * * *